US007083681B2

(12) United States Patent
Yamada et al.

(10) Patent No.: US 7,083,681 B2
(45) Date of Patent: Aug. 1, 2006

(54) METHOD FOR FORMING COATING FILM ON INTERNAL SURFACE OF ELONGATED TUBE AND UNIT FOR FORMING THE SAME

(75) Inventors: Hitoshi Yamada, Kawasaki (JP); Akira Tokai, Kawasaki (JP); Manabu Ishimoto, Kawasaki (JP); Kenji Awamoto, Kawasaki (JP); Tsutae Shinoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/033,175

(22) Filed: Jan. 12, 2005

(65) Prior Publication Data

US 2005/0115495 A1 Jun. 2, 2005

Related U.S. Application Data

(62) Division of application No. 10/391,765, filed on Mar. 20, 2003, now Pat. No. 6,893,677.

(30) Foreign Application Priority Data

Mar. 22, 2002 (JP) ..... 2002-081290

(51) Int. Cl.
*B05C 7/08* (2006.01)
*B05C 13/02* (2006.01)
*B05D 3/06* (2006.01)

(52) U.S. Cl. ..... 118/58; 118/69; 118/408; 118/411; 118/412; 118/642; 118/500; 118/DIG. 10

(58) Field of Classification Search ..... 118/408, 118/411, 412, 641–643, 58, 69, 500, DIG. 10; 65/417–420; 165/86, 88; 425/549; 264/328.15
See application file for complete search history.

(56) References Cited

U.S. PATENT DOCUMENTS

| | | | |
|---|---|---|---|
| 6,018,859 A | 2/2000 | Borzym et al. | |
| 6,363,754 B1 * | 4/2002 | Choi et al. | 65/417 |
| 6,399,145 B1 | 6/2002 | Jerebic et al. | |

FOREIGN PATENT DOCUMENTS

| | | |
|---|---|---|
| JP | 61-103187 | 5/1986 |
| JP | 11-162358 | 6/1999 |

* cited by examiner

*Primary Examiner*—Laura Edwards
(74) *Attorney, Agent, or Firm*—Westerman, Hattori, Daniels & Adrian, LLP.

(57) ABSTRACT

A method for forming a coating film on an internal surface of an elongated tube, includes longitudinally holding the elongated tube, applying a coating solution to the internal surface of the elongated tube; and drying the coating solution while carrying out a heat process for sequentially heating the elongated tube by using a heat source. The heat process includes adjusting the descending rate of the heat source so that a through-hole in the elongated tube is clogged with the coating solution whose viscosity is reduced by heating of the heat source, and sucking the through-hole in the elongated tube from the lower side thereof so that a portion of the through-hole that is clogged with the coating solution moves downwards along the elongated tube.

5 Claims, 9 Drawing Sheets

METHOD FOR FORMING COATING FILM ON INTERNAL SURFACE OF ELONGATED TUBE AND UNIT FOR FORMING THE SAME

CROSS-REFERENCE TO RELATED APPLICATION

This application is a division of Ser. No. 10/391,765, filed on Mar. 20, 2003 and issued as U.S. Pat. No. 6,893,677, which is related to Japanese application No. 2002-081290 filed on Mar. 22, 2002, whose priority is claimed under 35 USC § 119, the disclosure of which is incorporated by reference in its entirety.

BACKGROUND OF THE INVENTION

1. Field of the Invention

The present invention relates to a method for forming a coating film on an internal surface of an elongated tube and to a unit for forming the same. More particularly, the present invention relates to a method for forming a coating film on an internal surface of an elongated tube of a diameter of about 0.5 to 5 mm, the method allowing formation of a dried coating film, which is to serve as an electron emission layer, by performing, for example, heat treatment, and to a unit for forming the same.

2. Description of Related Art

As a display device, is known one in which a plurality of gas discharge tubes are arranged parallel to each other. This discharge device, using glass tubes of a diameter of about 0.5 to 5 mm, is so constructed that electrodes are formed outside the glass tubes; a discharge gas is enclosed in the glass tube to produce one gas discharge tube; and the plurality of gas discharge tubes are arranged in a row direction (or column direction) to constitute a display screen.

As such a display device, are known a large-scale gas discharge display panel described in Japanese Unexamined Patent Publication No. Sho 61(1986)-103187, an image-display device described in Japanese Unexamined Patent Publication No. Hei 11(1999)-162358 and the like. These display devices, as ones for large-scale display, are advantageous in reduced number of fabrication steps, reduced weight and costs, and ease of screen size change.

In the gas discharge tube used in the above-mentioned display devices, the electron emission layer is sometimes formed on a discharge surface, i.e., on the internal surface of the elongated tube, which is to serve as the gas discharge tube, for the purpose of improvement of the discharge characteristics such as lowering of a firing voltage. However, it is very difficult to form the electron emission layer on the internal surface of the elongated tube of a diameter of about 0.5 to 5 mm.

In the formation of the electron emission layer by deposition for example, molecules obtained by evaporation from a material introduced from an end of the elongated tube for forming the electron emission layer, deposit in a larger amount at an area nearer to the end of the elongated tube, and thus an uniform distribution of thickness is not achieved in the elongated tube. Nonuniformity of thickness of the electron emission layer causes variations of firing voltage at a plurality of emission points present in the elongated tube, resulting in a narrow margin of behavior for emission.

Accordingly, there has been demanded a method for forming a coating film, the method allowing easy formation of a dried coating film, which is to serve as the electron emission layer, by subjecting the internal surface of the elongated tube of a diameter of 0.5 to 5 mm to, for example, heat treatment.

SUMMARY OF THE INVENTION

The present invention has been made in view of the above circumstances and the main purpose thereof is to uniformly form a coating film on an internal surface of an elongated tube comprising the steps of: longitudinally holding the elongated tube for applying a coating solution to the internal surface of the elongated tube; and thereafter drying the coating solution applied to the internal surface of the elongated tube while heating the elongated tube from an upper side to a lower side thereof sequentially, wherein a through-hole in the elongated tube is clogged with the coating solution whose viscosity is reduced by heating.

The present invention provides a method for forming a coating film on an internal surface of an elongated tube, comprising: longitudinally holding the elongated tube to flow therethrough a coating solution containing a solvent whose viscosity is to be reduced by heating, so that the coating solution is applied to the internal surface of the elongated tube; and thereafter, drying the coating solution applied to the internal surface of the elongated tube while carrying out a heat process for sequentially heating the elongated tube from an upper side to a lower side thereof by using a heat source, the heat process including: adjusting the descending rate of the heat source so that a through-hole in the elongated tube is clogged with the coating solution whose viscosity is reduced by heating of the heat source; and sucking the through-hole in the elongated tube from the lower side thereof so that a portion of the through-hole that is clogged with the coating solution moves downwards along the elongated tube.

According to the present invention, when the coating solution applied to the internal surface of the elongated tube is dried while heating the elongated tube from the upper side to the lower side thereof sequentially, the descending rate of the heat source is adjusted so that the through-hole in the tube is clogged with the coating solution whose viscosity is reduced by heating using the heat source. Owing to surface tension of the coating solution, the coating solution applied to the internal surface of the elongated tube becomes uniform in amount in a direction crossing a longitudinal axis of the elongated tube. Consequently, the coating film of a uniform thickness cannot be formed on the internal surface of the elongated tube.

DESCRIPTION OF THE PREFERRED EMBODIMENTS

Figure 1:
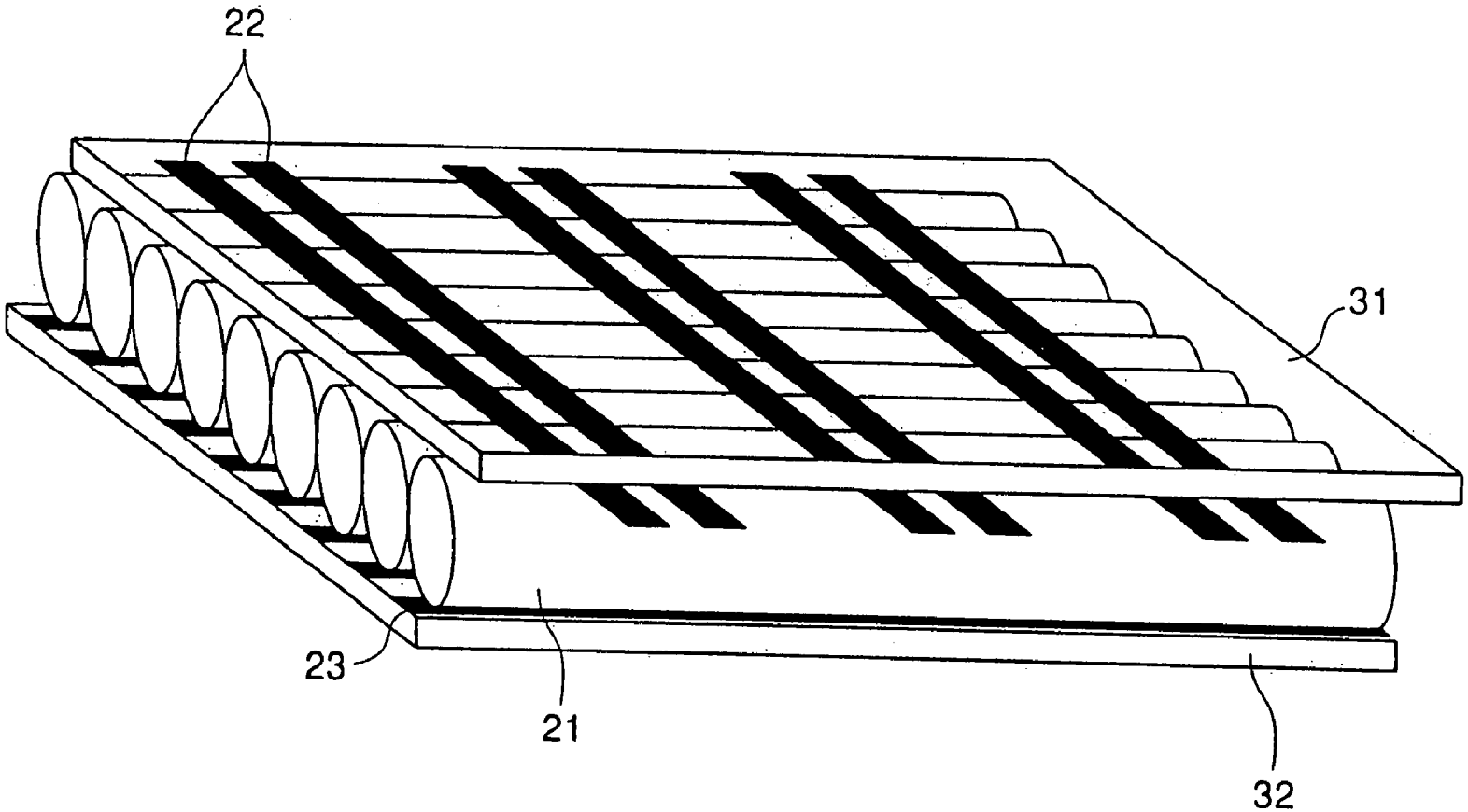
FIG. 1 is an explanatory view illustrating an embodiment of a display device constituted by gas discharge tubes each having an electron emission layer formed on an internal surface thereof by the method of the present invention.

The method for forming a coating film on an internal surface of an elongated tube according to the present invention is preferably used for formation of a coating film on an internal surface of an elongated tube of a diameter of about 0.5 to 5 mm. However, the method is not limited thereto, and may be practiced using an elongated tube of any diameter if it has a through-hole of a diameter to be clogged with a coating solution heated by a heat source. The elongated tube may be of any shape in cross section such as circle, flat ellipse, rectangle or the like. Also, the elongated tube may be a rigid, straight-extending one as well as a resilient one.

The coating solution may be any if it contains a solvent whose viscosity is to be reduced by heating. The solvent may be any known solvent in the art. As the solvent, may be mentioned ethanol, ethylene glycol or the like.

As the coating solution, may be used any coating solution such as one used for formation of electron emission layers, phosphor layers, conductive films (electrons) or the like. If the electron emission layer is to be formed on the internal surface of the elongated tube, may be used a solution of magnesium salt of a fatty acid, e.g. a magnesium caproate in the above solvent.

The heat source may be any if it can dry the coating solution applied to the internal surface of the elongated tube while heating the elongated tube from the upper side to the lower side thereof sequentially. The heat source is not especially limited, and may be any heater such as an electric heater (electrothermal heater), an infrared heater or a gas heater.

In the method for forming a coating film on an internal surface of an elongated tube according to the present invention, the thickness of the coating film formed on the internal surface of the elongated tube can be varied by varying the temperature of the heat source.

The heat source may be constituted by a heater shaped like a ring arranged around the elongated tube and having distribution of temperatures at a ring-like portion of the heater, so that the heater allows the thickness of the coating film to be varied on the internal surface in a direction crossing a longitudinal axis of the elongated tube.

It is also possible to vary the thickness of the coating film formed on the internal surface of the elongated tube by varying the descending rate of the heat source.

Further, the coating solution below a heating position, of the heat source may be cooled to adjust a position at which the through-hole is clogged.

In the method for forming a coating film according to the present invention, it is desirable to keep warm the coating film formed on the internal surface of the elongated tube so as to protect it from adhesion of a solvent.

Moreover, by an equipment for forming an external coating film, the method may further include forming another coating film on an external surface of the elongated tube, simultaneously with formation of the coating film on the internal surface of the elongated tube, while using in common the single heat source to form the coating films on the internal and external surfaces of the elongated tube.

The present invention also provides a unit for forming a coating film on an internal surface of an elongated tube comprising: a holder for longitudinally holding an elongated tube; a first pump for flowing through the elongated tube a coating solution containing a solvent whose viscosity is to be reduced by heating, so that the coating solution is applied to the internal surface of the elongated tube; a first heat source for heating the coating solution applied to the internal surface of the elongated tube; a slider for moving the heat source along the elongated tube from the upper side to the lower side thereof sequentially, so that the coating solution applied to the internal surface of the elongated tube can be dried while heating the elongated tube from the upper side to the lower side thereof sequentially; a controller for controlling the moving rate of the slider, while the heat source is moved along the elongated tube from the upper side to the lower side thereof sequentially, to adjust the descending rate of heat source so that a through-hole in the elongated tube is clogged with the coating solution whose viscosity is reduced by heating using the heat source; and a second pump for exerting suction through the through-hole from the lower side of the elongated tube so that a clogged portion of the through-hole moves downwards.

The unit may further include a cooler for cooling the coating solution below a heating position of the heat source to adjust a position at which the through-hole is clogged.

Also, the unit may further include a second heat source for keeping warm the coating film formed on the internal surface of the elongated tube so as to protect the coating film from adhesion of a solvent.

The above unit for forming a coating film may be so constructed that the holder is capable of holding a plurality of elongated tubes; the heat source comprises a plurality of heat sources capable of respectively heating the plurality of elongated tubes; and the slider is capable of moving the plurality of heat sources.

The present invention will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

A method for forming a coating film on an internal surface of an elongated tube according to the present invention is preferably used for formation of an electron emission layer on an internal surface of an elongated tube of a diameter of about 0.5 to 5 mm. This elongated tube is preferably used for a display device in which gas discharge tubes, made of elongated tubes, of a diameter of about 0.5 to 5 mm are arranged parallel to each other to constitute a display screen. An embodiment of the display device will be described.

FIG. 1 is an explanatory view illustrating an embodiment of a display device constituted by gas discharge tubes each having an electron emission layer formed on an internal surface thereof by the method of the present invention.

In the drawing, numeral reference 31 denotes a front substrate, 32 a rear substrate, 21 gas discharge tubes, 22 display electrode pairs (main electrode pairs), and 23 signal electrodes (data electrodes).

Inside a gas discharge tube 21 (within a discharge space), an electron emission layer and a phosphor layer are formed, a discharge gas is introduced, and both ends are sealed. The signal electrodes 23 are formed on the rear substrate 32, in a longitudinal direction of the tubes 21. The display electrode pairs 22 are formed on the front substrate 31, in a direction crossing the signal electrodes 23.

In assembly of the display device, the signal electrodes 23 and the display electrode pairs 22 are closely contacted with an outer periphery of the tube 21 at an upper side and a lower side, respectively. A conductive adhesive may be interposed between the display electrode 22 and the outer periphery of the tube 21 at the upper side to improve the contact therebetween.

An area where the signal electrode 23 intersects the display electrode pair 22 is a unit luminous area, when the display device is viewed in plan. Display is performed as follows. Using, as a scanning electrode, either one electrode of the display electrode pair 22, a selection discharge is generated at the area where the scanning electrode intersects the signal electrode 23 so as to select a luminous area. Utilizing, simultaneously with emission of light, a wall charge provided within the tube in the luminous area, display discharges are generated between the display electrode pair 22. A selection discharge is an opposite discharge generated within the tube 21 between the scanning electrode and the signal electrode 23, opposed to each other in a vertical direction. A display discharge is a surface discharge generated within the tube 21 between the display electrode pair 22, disposed parallel to each other on a plane.

In FIG. 1, three electrodes are arranged at one luminous area so that display discharges are generated between the display electrode pair 22, but the manner of generating display discharges is not limited thereto, and display discharges may be generated between the display electrode 22 and the signal electrode 23.

In other words, such a construction may be designed that the display electrode pair 22 is used as one electrode and the display electrode 2 thus obtained is used a scanning electrode, so that selection discharges and display discharges (opposite discharges) are generated between the display electrode 22 and the signal electrode 23.

Figure 2:
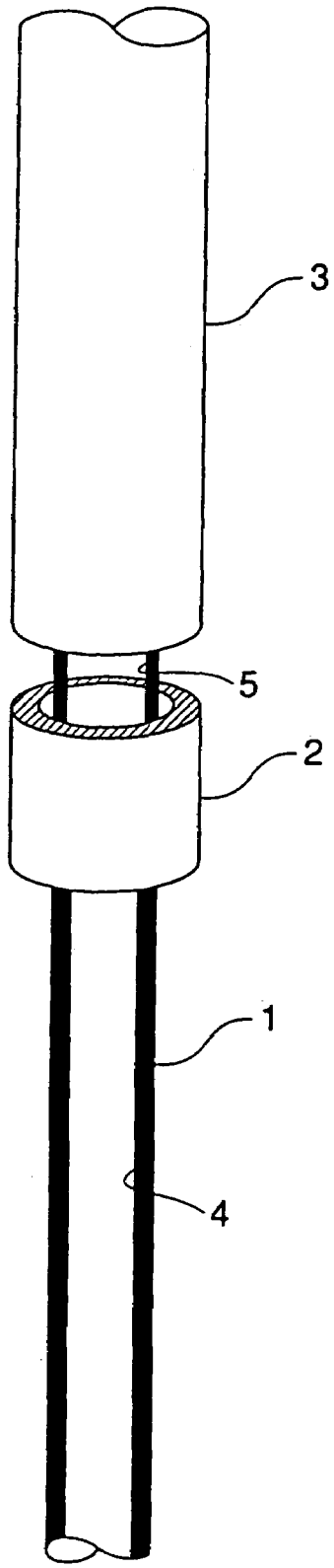
FIG. 2 is an explanatory view illustrating a coating film being formed in the elongated tube by the method according to the present invention.

FIG. 2 is an explanatory view illustrating the coating film being formed in the elongated tube by the method according to the present invention. Here, the coating film is formed for formation of the electron emission layer on the internal surface of the elongated tube.

In this drawing, numeral reference 1 denotes an elongated tube to serve as a gas discharge tube, 2 a first heater, 3 a second heater, 4 a coating solution applied to an internal surface of the tube 1, 5 a coating film formed on an internal surface of the tube 1. The tube 1 is made of borosilicate glass, and has an outer diameter of about 1 mm, a material thickness of about 100 μm and a length of about 200 mm.

The first heater 2 is a relatively small-sized electric heater for reducing the viscosity of the coating solution 4 applied to the internal surface of the tube 1, and, at the same time, dries the coating solution 4 to form the coating film 5. The first heater 2 is 20 mm long. The first heater 2 is set at a temperature of about 120° C.

The second heater 3 is a relatively large-sized electric heater for keeping warm the coating film 5 formed by the first heater 2 on the internal surface of tube 1 for protecting the coating film 5 from adhesion of a solvent. The second heater 3 has substantially the same length as that of the tube 1. The second heater 3 is set at a temperature of about 90° C.

The first heater 2 and the second heater 3 are simultaneously moved downwards along the tube 1 with a constant spacing kept between the first heater 2 and the second heater 3 all the time. In this embodiment, a 10 mm spacing is kept between the first heater 2 and the second heater 3. However, no spacing may be given if the temperature gradient between the first heater 2 and second heater 3 is suitably adjusted.

The tube 1 is longitudinally held, and, to the internal surface thereof, the coating solution 4 has already been applied at normal temperature. The coating solution 4 contains a solvent whose viscosity is to be reduced by heating. The coating solution 4 has been flowed through a through-hole formed in the tube 1 to clog the through-hole, so that the coating solution 4 has been applied to the internal surface of the tube 1.

As the coating solution 4, may be used a solution of magnesium salt of a fatty acid, e.g. a magnesium caproate solution or the like. As the solvent in the coating solution 4, may be used ethanol, ethylene glycol or the like.

The coating solution 4 is applied at normal temperature and has a thickness of about 50 μm when not dried. The viscosity of the coating solution 4 is to be reduced by heating.

Figure 3:
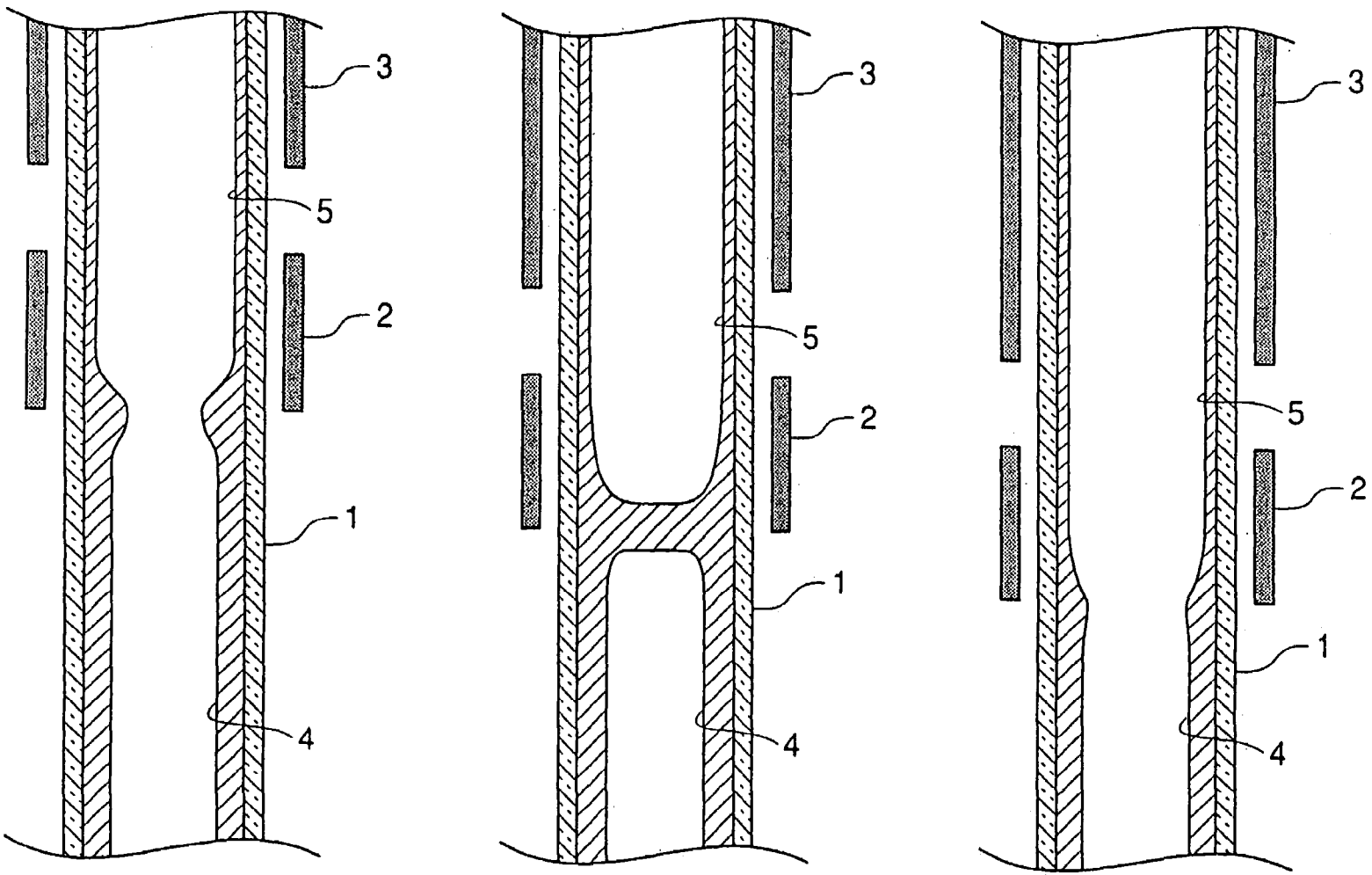
FIGS. 3(*a*) to 3(*c*) are explanatory views illustrating an embodiment of the method according to the present invention.

FIGS. 3(*a*) to 3(*c*) are explanatory views illustrating an embodiment of the method according to the present invention. These drawings are cross sectional views of the tube 1.

In the method according to the present invention, the tube 1 is longitudinally held to flow the coating solution 4 such as the above-mentioned magnesium caproate solution through the tube 1 at normal temperature, so that the coating solution 4 is applied to the internal surface of the tube 1.

Then, a negative pressure is formed at a lower side of the tube 1. That is, weak suction is exerted through the through-hole in the tube 1 from the lower side thereof all the time.

Subsequently, the tube 1 is heated at a top thereof by the first heater 2. This heating reduces the viscosity of the coating solution 4 at an area opposite from the first heater 2, so that the coating solution 4 runs downwards along the tube 1. Thereby, the coating solution 4 at the area adjacent to the first heater 2 becomes thinner than when applied at normal temperature. The coating solution 4 at the thus thinned area is dried to form the coating film 5 (see FIG. 3(*a*)).

Next, when the first heater 2 and the second heater 3 are moved downwards along the tube 1 with the constant spacing kept between the first heater 2 and the second heater 3, the through-hole in the tube 1 is clogged with the coating solution 4 to form a pool of the coating solution (hereafter, referred to as a solution pool) (FIG. 3(*b*)).

A clogged portion of the through-hole in the tube 1 is thus formed, and then moves downwards, since suction is exerted through the through-hole in the tube 1 from the lower side of the tube 1 all the time. Then, again, the viscosity of the coating solution 4 is reduced at another area opposite from the first heater 2, so that the coating solution 4 at that area runs downwards to be thinned and dried to form the coating film (electron emission layer) 5 at the thus thinned area (see FIG. 3(*c*)).

The thickness of the coating film 5 is determined depending on the temperature of the first heater 2. That is, the thickness of the coating film 5 corresponds both to the viscosity and to the drying rate of the coating solution 4, under the temperature of the first heater 2.

Thus, the solution pool is formed at the position below the first heater 2 but not so far from the first heater 2, for example, about 100 mm below the first heater 2. The solution pools are repeatedly formed at the positions in sequence until the first heater 2 and the second heater 3 reach the lower side of the tube 1. Thus, the coating film 5 is formed on an entire internal surface of the tube 1.

By clogging the through-hole of the tube 1 with the coating solution 4 to form the solution pools, surface tension of the coating solution 4 evenly acts circumferentially of the tube 1. Thereby, the coating solution 4 has a uniform thickness circumferentially of the tube 1.

The first heater 1 has two functions, one of reducing the viscosity of the coating solution 4 and the other of drying the coating solution 4. Therefore, the first heater 2 may be composed of two heaters each having one function. In that case, one heater for reducing the viscosity of the coating solution 4 is positioned ahead of the scanning direction (downwards in terms of the tube 1) and the other heater for drying the coating solution 4 is positioned behind it.

The thickness of the coating film 5 can be varied by varying any one of three parameters consisting of viscosity of the coating solution 4, heating temperature of the first heater 2, and descending rate of the first heater 2. The coating film 5 becomes thicker as the viscosity of the coating solution 4 is increased. So it does as the heating temperature of the first heater 2 is increased, since the coating solution 4 dries faster. So it does as the descending rate of the first heater 2 is increased, since the period for the coating solution 4 to flow down becomes shorter.

The coating film 5 can be made 0.5 μm thick for example, by adjusting the viscosity of the solution of magnesium salt of a fatty acid, e.g. a magnesium caproate solution to about 50 mPa·s, the heating temperature of the first heater 2 to about 120° C., and the descending rate of the first heater 2 to about 1 mm/sec.

Figure 4:
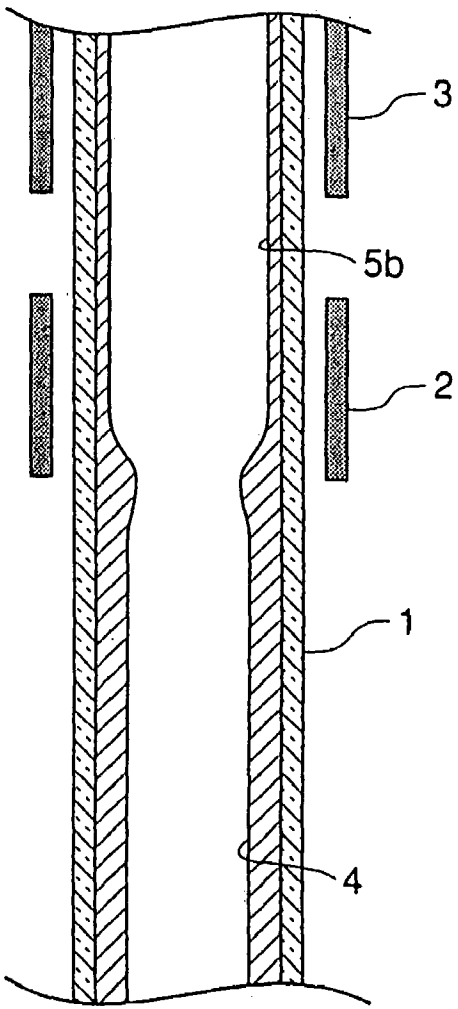
FIGS. 4(*a*) and 4(*b*) are explanatory views illustrating an embodiment in which the thickness of the coating film is varied depending on unit application areas of the coating film.
Figure 4:
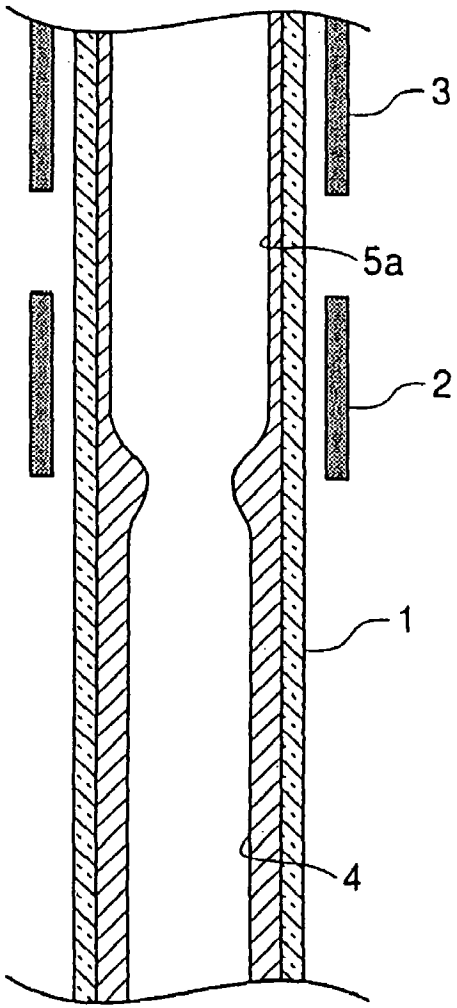

FIGS. 4(*a*) and 4(*b*) are explanatory views illustrating an embodiment in which the thickness of the coating film is varied depending on unit application areas of the coating film.

In this embodiment, the thickness of the coating film 5 is varied depending on unit application areas of the coating film 5 by varying the temperature of the first heater 2. A unit application area of the coating film 5 has a uniform thickness.

As mentioned above, the thickness of the coating film depends on the temperature of the first heater 2. That is, as the temperature of the first heater 2 is increased, the coating film 5 becomes thicker, since the coating solution 4 dries earlier than a large amount of it flows out. On the contrary, as the temperature of the first heater 2 is lowered, the coating film 5 becomes thinner, since the coating solution 4 dries later than a large amount of it flows out.

The reason is that the thickness of the coating film 5 is dependent more on the drying rate than on the viscosity of the coating solution 4 although, as the temperature of the first heater 2 is increased, the viscosity of the coating solution 4 is more reduced.

Figure 5:
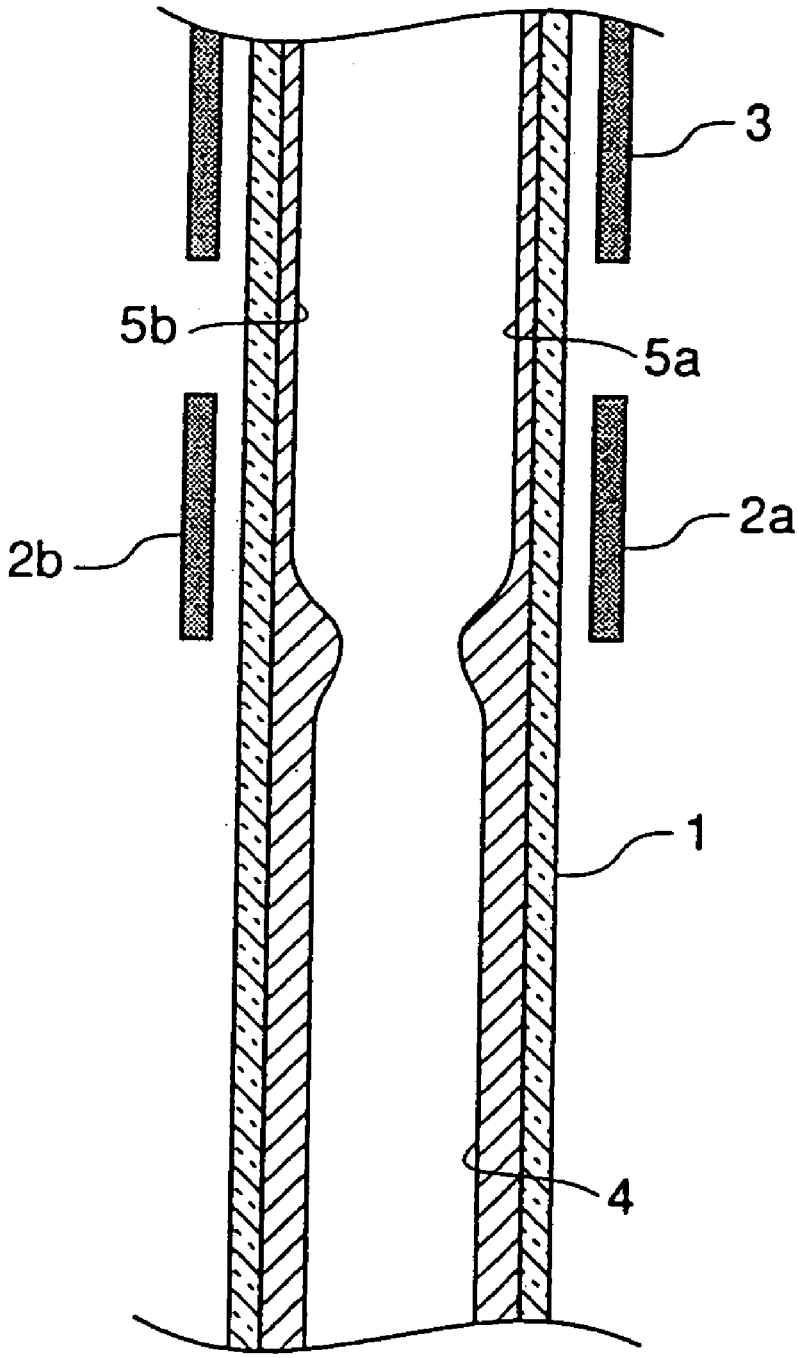
FIG. 5 is an explanatory view illustrating an embodiment in which the coating film has distribution of thicknesses.

Accordingly, if the temperature of the first heater 2 is lowered, a thinner coating film 5*a* can be formed (see FIG. 5(*a*)), and if the temperature of the first heater 2 is increased, a thicker coating film 5*b* can be formed (see FIG. 5(*b*)).

FIG. 5 is an explanatory view illustrating an embodiment in which the coating film has distribution of thicknesses.

In this embodiment, the coating film 5 is formed by varying its thickness circumferentially on the internal surface of tube 1. For this purpose, the first heater 2 has distribution of temperatures. That is, the first heater 2 is composed of a lower-temperature section 2*a* and a higher-temperature section 2*b*.

By thus composing the first heater 2, a thicker coating film 5*b* is formed at an area opposite from the higher-temperature section 2*b* of the first heater 1, and a thinner coating film 5*a* is formed at an area opposite from the lower-temperature section 2*a* of the first heater 1, since, as the temperature is increased, the coating solution 4 is dried earlier so that the coating film 5 is thickened more. Thereby, the thickness of the coating film 5 can be varied circumferentially of the tube 1.

Figure 6:
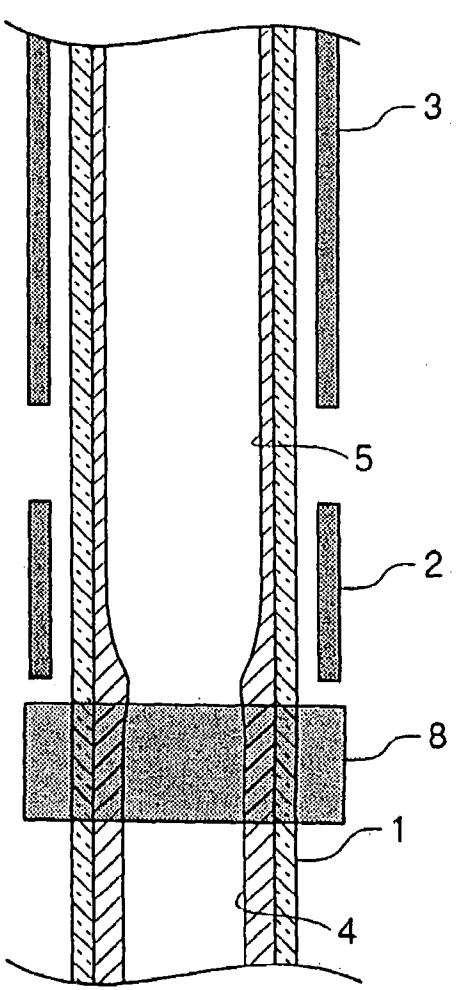
FIGS. 6(*a*) to 6(*c*) are views explanatory illustrating an embodiment in which the position of a pool of a coating solution is controlled by cooling the tube 1.
Figure 6:
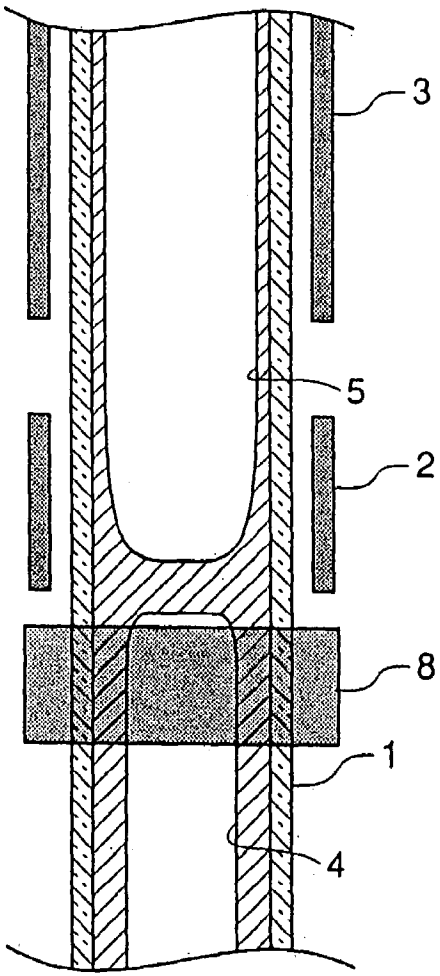
Figure 6:
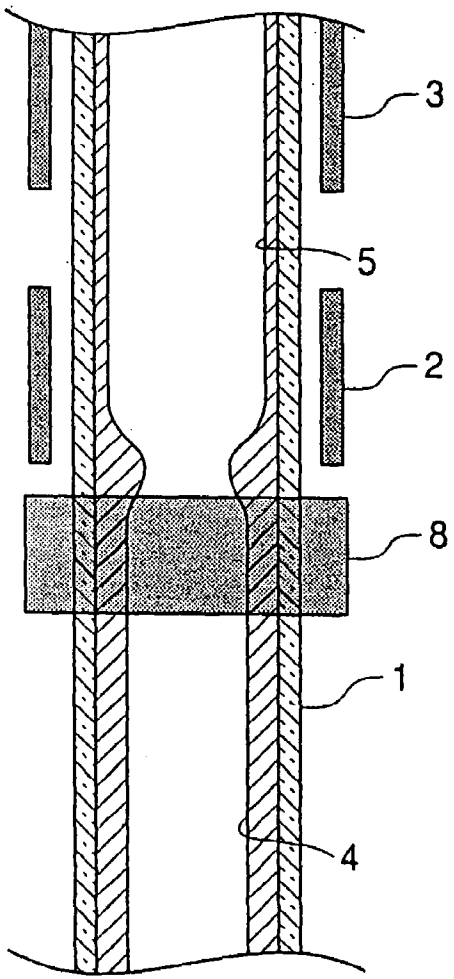

FIGS. 6(*a*) to 6(*c*) are views explanatory illustrating an embodiment in which the position of the solution pool is controlled by cooling the tube 1.

In this embodiment, a cooler 8 is used for cooling an outside of the tube 1 and thereby for cooling the coating solution 4.

First, heating is started from a top of the tube 1 by the first heater 2. This reduces the viscosity of the coating solution 4 at the area opposite from the first heater 2. Simultaneously with the reduction of the viscosity of the coating solution 4, the first heater 2 and the second heater 3 are moved downwards along the tube 1 while cooling the tube 1 below the first heater 1 by the cooler 8. The first heater 2 has the same heating temperature as that in the embodiment of FIG. 3(*a*). Due to the reduction of the viscosity, the coating solution 4 at the area adjacent to the first heater 2 runs downwards (FIG. 6(*a*)).

Next, when the first heater 2 and the second heater 3 are moved downwards along the tube 1 with the constant spacing kept between the first heater 2 and the second heater 3, the viscosity of the coating solution 4 is increased at an area cooled by the cooler 8. Accordingly, the through-hole in the tube 1 is clogged with the coating solution 4 above the cooler 8 to form a solution pool (FIG. 6(*b*)).

A clogged portion of the through-hole in the tube 1 is thus formed, and then moves downwards, since suction is exerted through the through-hole in the tube 1 from the lower side of the tube 1 all the time. Then, again, as the viscosity of the coating solution 4 is reduced at another area opposite from the first heater 2, the coating solution at that area runs downwards to be thinned and dried to form a coating film 5 at the thus thinned area (see FIG. 6(*c*)).

Owing to the cooler 8, the solution pool can be forcibly formed at the position spaced a predetermined distance from the first heater 2.

Thereby, the solution pool can be prevented from being so far from the first heater 2 as to lessen the effect of the solution pool on uniform formation of the coating solution 4 circumferentially of the tube 1.

Figure 7:
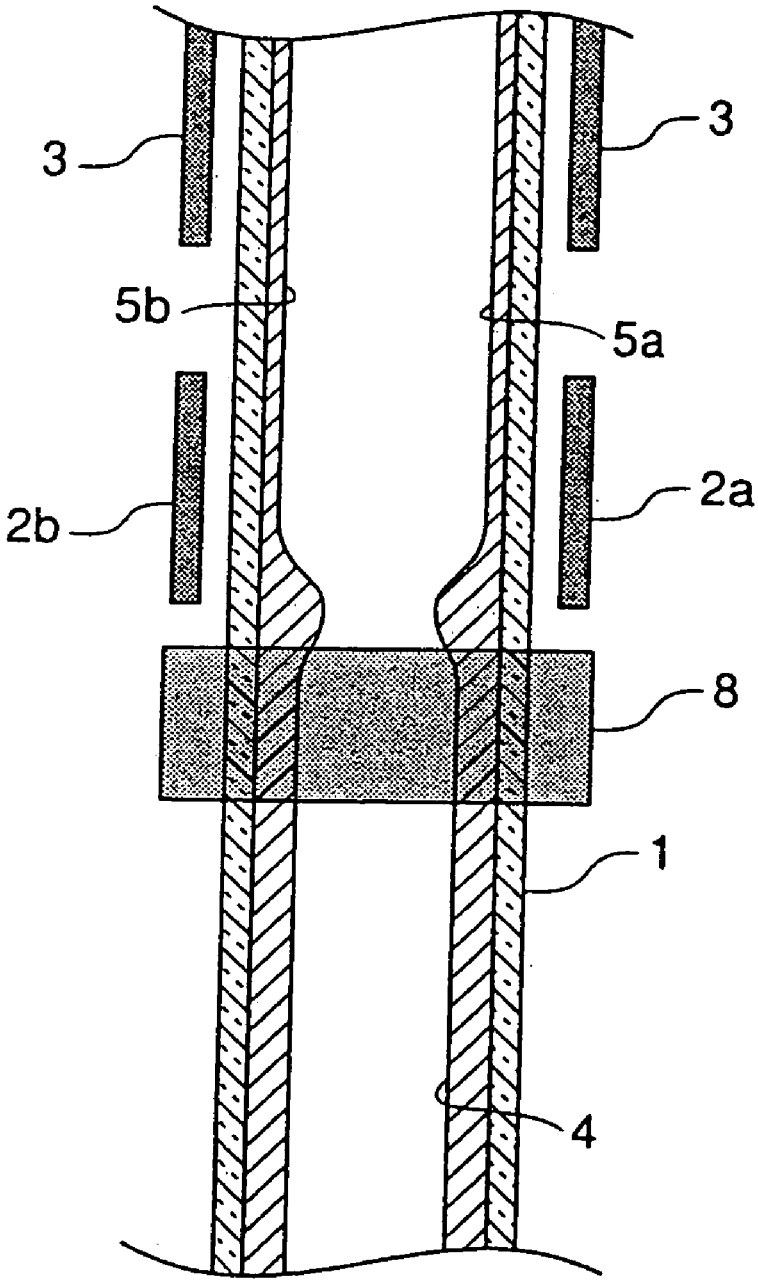
FIG. 7 is an explanatory view illustrating an embodiment in which the coating film has distribution of thicknesses and the position of the solution pool is controlled by cooling the tube 1.

FIG. 7 is an explanatory view illustrating an embodiment in which the coating film has distribution of thicknesses and the position of the solution pool is controlled by cooling the tube 1.

In this embodiment, the manner shown in FIGS. 5(*a*) and 5(*b*) is applied to form a thinner coating film 5*a* and a thicker coating film 5*b* on the internal surface of tube 1 by varying the thickness of the coating film 5 circumferentially of the tube 1. At the same time, the position of the solution pool is controlled by cooling the tube 1 by the cooler 8. The cooler 8 is disposed at the same position as that in the embodiment of FIGS. 6(*a*) to 6(*c*).

As a result, not only the thickness of the coating film 5 can be varied circumferentially of the tube 1, but also the solution pool can be forcibly formed at the position spaced a predetermined distance from the first heater 2.

Figure 8:
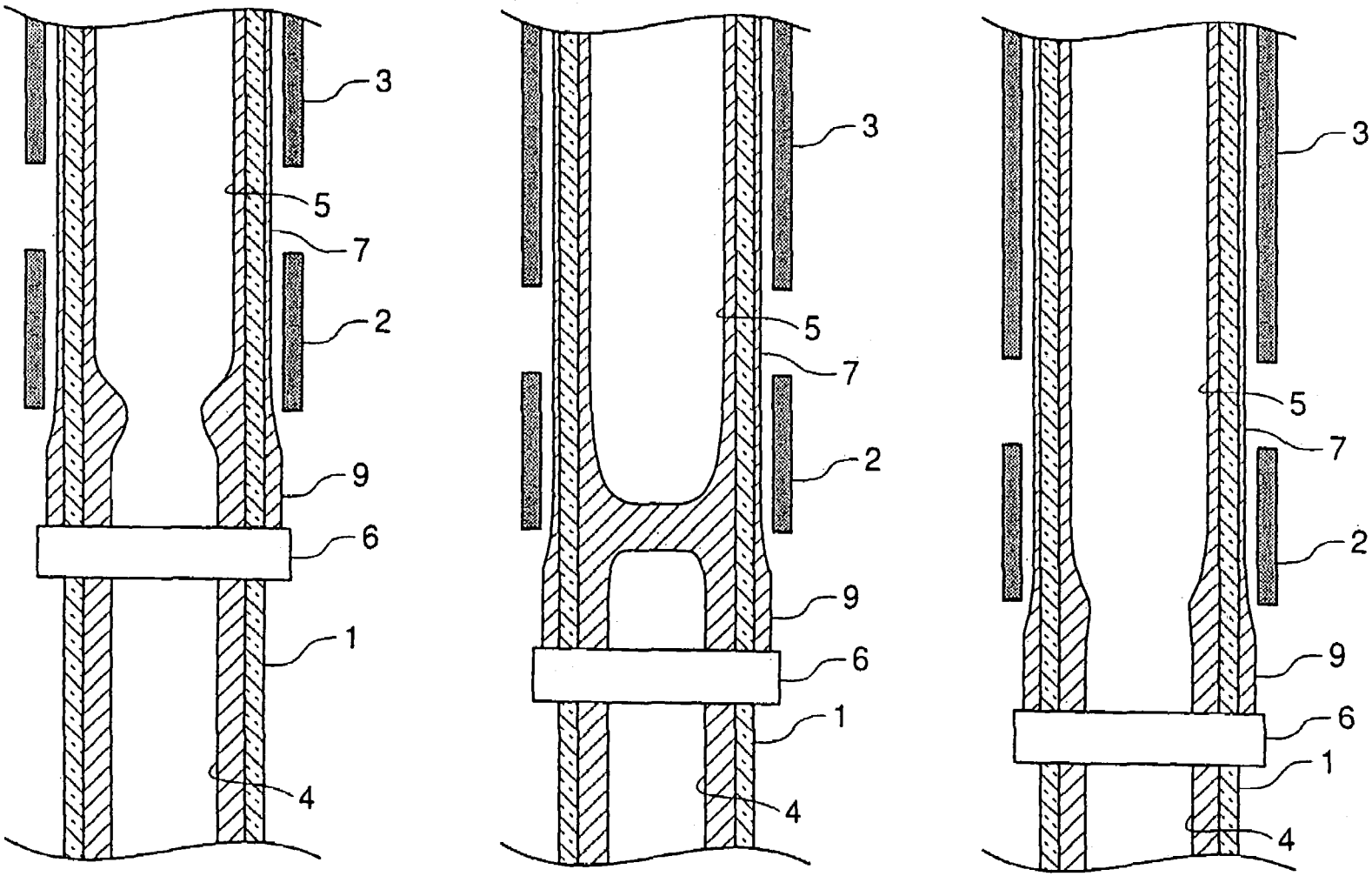
FIGS. 8(*a*) to 8(*c*) are explanatory views illustrating an embodiment in which the coating films are formed both on the internal surface and on an external surface of the tube 1, simultaneously.

FIGS. 8(*a*) to 8(*c*) are explanatory views illustrating an embodiment in which the coating films are formed both on the internal surface and on an external surface of the tube 1, simultaneously.

In this embodiment, simultaneously with application of the coating solution 4 to the above-mentioned internal surface of the tube 1 and drying of it to form the coating film 5*a*, a coating equipment 6 for forming an external coating film is used for application of an external coating solution 9 to the external surface of the tube 1 and drying of it to form an external coating film 7. The coating film 7 may be formed of a material different from that used for formation of the coating film 5 on the internal surface of the tube 1. The external coating film 7 may be formed either on an entire or partial external surface of the tube 1. As for the internal surface of the tube 1, the coating film 5 is formed on it in the same manner as in the embodiment of FIGS. 3(*a*) to 3(*c*).

For formation of the coating film 7, the first heater 1 is used in common to dry the coating solution 4 on the internal surface and the external coating solution 9 on the external surface, simultaneously. The second heater 3 is also used in common to protect the coating film 5 from adhesion of the solvent to the internal surface of the tube 1 and the external coating film 7 from adhesion of the solvent to the external surface, simultaneously.

As the external coating film 7 formed on the external surface of the tube 1, may be mentioned a protection film for protecting the tube 1 from breakage or a conductive film (electrode). The protection film is formed on the entire external surface of the tube 1 and the electrode is formed on the partial external surface of the tube 1.

As the protection film, may be used a metal oxide film such as an oxide titanium film. In that case, a solution containing such a metal oxide is used as the coating solution, and it is dried to form the metal oxide film.

As the conductive film, may be used a metal film such as a gold, silver or aluminum film. In that case, a solution containing such a metal is used as the coating solution, and it is dried to form the metal film.

The coating film 5 formed on the internal surface of the tube 1 is fired in a later step, and also the external coating film 7 formed on the external surface is fired simultaneously in the step.

Figure 9:
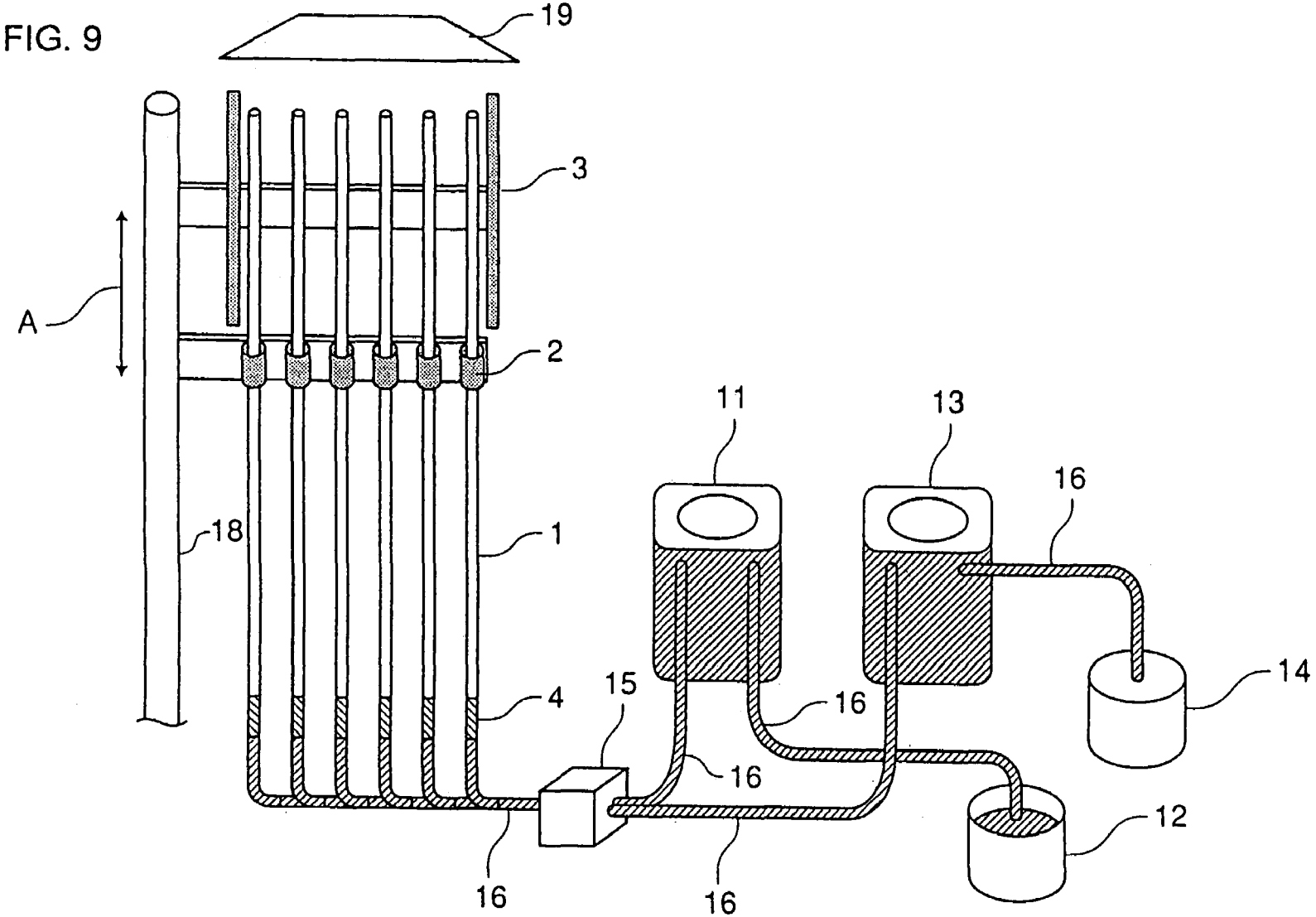
FIG. 9 is an explanatory view illustrating a unit for forming a coating film on the internal surface of the elongated tube according to the present invention.

FIG. 9 is an explanatory view illustrating a unit for forming a coating film on an internal surface of an elongated tube according to the present invention.

In the drawing, reference numeral 11 indicates a solution transferring and collecting pump, 12 a solution storing sector, 13 a waste-solution pump, 14 a waste-solution storing sector, 15 a solenoid valve, 16 a transfer hose, 18 a power slider and 19 an exhauster.

The film-forming unit according to the present invention forms a plurality of coating films on internal surfaces of a plurality of tubes 1, simultaneously. The plurality of tubes 1 are held longitudinally by a holder (not shown).

The power slider 18 is capable of being moved in a direction indicated by arrow A in FIG. 9. The first heaters 2 and the second heaters 3 are attached to the power slider 18 and moved in the direction indicated by arrow A shown in FIG. 9 in accordance with a movement of the power slider 18. The first heaters 2 are of a length capable of covering part of the tube 1, and the second heaters 3 are of a length capable of longitudinally covering the whole of the tube 1.

The solution transferring and collecting pump 11 sucks the coating solution 4 from the solution storing sector 12 into the tube 1 for applying the coating solution 4 to the internal surface of the tube 1, and then sucks the coating solution 4 from tube 1 into the solution storing sector 12 again.

The waste-solution pump 13 sucks the coating solution 4 of the solution pool formed at the formation of the coating film 5 on the internal surface of the tube 1, and then discharges the coating solution 4 into the waste-solution storing sector 14.

The solenoid valve 15 switches between the solution transferring and collecting pump 11 and the waste-solution pump 13.

The exhauster 19 exhausts the solvent, which is a volatile component discharged out of a mouth of the tube 1 at an upper side thereof when the coating solution 4 is dried.

Operations of the film-forming unit will now be explained below.

First, the coating solution 4 is applied to the internal surface of the tube 1 as follows. The coating solution 4 is sucked by the solution transferring and collecting pump 11 from the solution storing sector 12 into the tube 1 via the lower side thereof. The coating solution 4 is then sucked from the tube 1 via the lower side thereof, again into the solution storage section 12. Subsequently, the solenoid valve is switched.

Next, the power slider 18 is moved (or moved beforehand) upwards along the tube 1 to position the first heater 2 and the second heater 3 at the upper side of the tube 1. Electric current is passed through the first heater 2 and the second heater 3 to heat the coating solution in the tube 1 at the upper side thereof. Thereby, a solution pool is formed below the first heater 2, and it is then sucked by the waste-solution pump 13 to be discharged into the waste-solution pump 14.

While the solution pool is sucked, the power slider 18 is gradually descended so that new solution pools are formed below the first heater 2 all the time. These operations are sequentially repeated until the first heater 2 and the second heater 3 reaches the lower side of the tube 1. Thus, a coating film of a uniform thickness can be formed on the entire internal surface of the tube 1.

After drying, the coating film can be fired to form an electron emission layer. By firing the tube 1, which contains the coating film, in a furnace at a temperature of, for example about 400° C., the transparent electron emission layer of magnesium oxide can be formed in a thickness of, for example, about 0.5 μm.

Thus, the electron emission layer of a uniform thickness is formed on the internal surface of the tube 1 even if the tube 1 is of a diameter of 2 mm or less and of a length exceeding 300 mm.

In the above construction, the first heater 1 is moved along the tube 1. However, such a construction is also possible that the first heater 2 is formed of a length capable of longitudinally covering the whole of the tube 1, and the heat sources are arranged in blocks, so that the tube 1 is scanned under heating by passing electric current through the first heater 1.

Thus, when the coating solution applied to the internal surface of the elongated tube is dried while heating the elongated tube from the upper side to the lower side thereof sequentially, the through-hole in the tube is clogged with the coating solution whose viscosity is reduced. Accordingly, well-balanced uniform physical force of the coating solution can be obtained circumferentially of the elongated tube, which allows the coating film to have a uniform thickness.

According to the present invention, when the coating solution applied to the internal surface of the elongated tube is dried while heating the elongated tube from the upper side to the lower side thereof sequentially using the heat source, the descending rate of the heat source is adjusted so that the through-hole in the tube is clogged with the coating solution whose viscosity is reduced by heating. Owing to surface tension of the coating solution, the coating solution applied to the internal surface of the elongated tube becomes uniform in amount in a direction crossing a longitudinal axis of the elongated tube. Consequently, the coating film of a uniform thickness can be formed on the internal surface of the elongated tube.

We claim:

1. A unit for forming a coating film on an internal surface of an elongated tube comprising:

a holder for longitudinally holding an elongated tube;

a first pump for flowing through the elongated tube a coating solution containing a solvent whose viscosity is to be reduced by heating, so that the coating solution is applied to the internal surface of the elongated tube;

a first heat source for heating the coating solution applied to the internal surface of the elongated tube;

a slider for moving the heat source along the elongated tube from an upper side to a lower side thereof sequentially, so that the coating solution in the elongated tube can be dried while heating the elongated tube from the upper side to the lower side thereof sequentially;

a controller for controlling the moving rate of the slider, while the heat source is moved along the elongated tube from the upper side to the lower side thereof sequentially, to adjust the moving rate of heat source so that a through-hole in the elongated tube is clogged with the coating solution whose viscosity is reduced by heating using the heat source; and a second pump for exerting suction through the through-hole from the lower side of the elongated tube so that a clogged portion of the through-hole moves downwards.

2. The unit according to claim 1, further comprising a cooler for cooling the coating solution below a heating position of the heat source to adjust a position at which the through-hole is clogged.

3. The unit according to claim 1, further comprising a second heat source for keeping warm the coating film formed on the internal surface of the elongated tube so as to protect the coating film from adhesion of a solvent.

4. The unit according to claim 1, wherein the holder is capable of holding a plurality of elongated tubes;

the first heat source comprises a plurality of heat sources capable of respectively heating the plurality of elongated tubes; and the slider is capable of moving the plurality of heat sources.

5. The unit according to claim 1, wherein said first heat source comprises an annular heater arranged around the elongated tube and having a distribution of temperatures among different sections of the heater, so that the heater allows the thickness of the coating film to be varied on the internal surface in a direction crossing a longitudinal axis of the elongated tube.

* * * * *